US005771488A

United States Patent [19]

Honkala

[11] Patent Number: 5,771,488

[45] Date of Patent: Jun. 30, 1998

[54] IMPACT-RESISTANT PROTECTIVE GARMENT

[75] Inventor: Markku Honkala, Tampere, Finland

[73] Assignee: Valtion Teknillinen Tutkimuskeskus, Espoo, Finland

[21] Appl. No.: 793,009

[22] PCT Filed: Jun. 6, 1996

[86] PCT No.: PCT/FI96/00336

§ 371 Date: Feb. 5, 1997

§ 102(e) Date: Feb. 5, 1997

[87] PCT Pub. No.: WO96/39881

PCT Pub. Date: Dec. 19, 1996

[30] Foreign Application Priority Data

Jun. 7, 1995 [FI] Finland ..... 952783

[51] Int. Cl.[6] ..... A41D 13/00

[52] U.S. Cl. ..... 2/2.5; 2/102

[58] Field of Search ..... 2/455, 456, 463, 2/2.5, 16, 159, 161.6, 102; 428/911, 222

[56] References Cited

U.S. PATENT DOCUMENTS

| | | | |
|---|---|---|---|
| 4,356,569 | 11/1982 | Sullivan | 428/911 X |
| 4,493,865 | 1/1985 | Kuhlmann et al. | 2/16 X |
| 4,507,353 | 3/1985 | Kuhlmann et al. . | |
| 4,802,242 | 2/1989 | Lars-Jos . | |
| 4,841,577 | 6/1989 | Lars-Jos . | |
| 5,511,241 | 4/1996 | Ziegler | 2/2.5 |

*Primary Examiner*—Paul C. Lewis
*Attorney, Agent, or Firm*—Pollock, Vande Sande & Priddy

[57] ABSTRACT

An impact-resistant garment comprises closed rings (2) joined together to form a layer (1) protecting against impacts inside the garment. Elongate filling elements (3) of limited flexibility are threaded through the rings (2) to prevent the penetration of spike-shaped objects through the rings (2).

10 Claims, 1 Drawing Sheet

IMPACT-RESISTANT PROTECTIVE GARMENT

Figure 1:
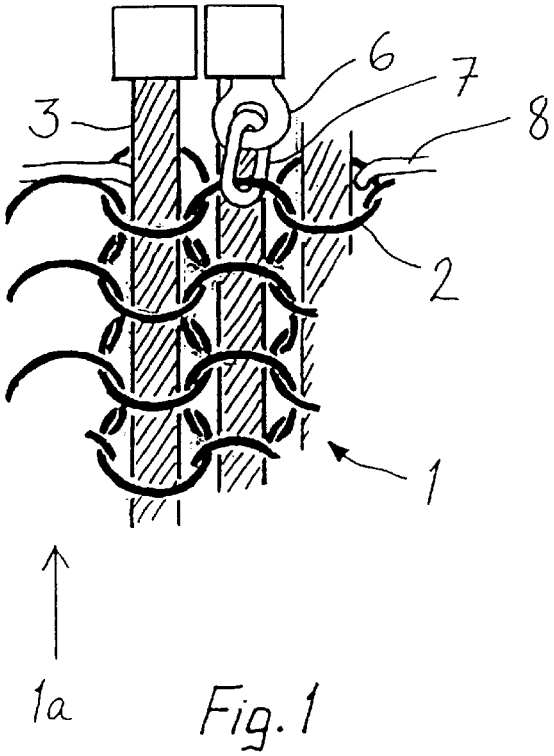

The present invention relates to an impact-resistant protective garment comprising closed rings joined together to form a layer inside the garment to afford protection against impacts. The protective structures of this kind are commonly known, and reference is made especially to European Patent Application no. 119406 showing a typical protective layer consisting of rings. These structures are used for instance in butcher's aprons to prevent sharp objects from penetrating through the garment, because closed rings attached to each other prevent the passage of such objects where the part penetrating through the garment would be a long cutting edge.

The above-mentioned structure is, however, insufficient if the passage of objects with a sharp point acting as a part penetrating through the garment is to be prevented. The point of a spike can manage to get through a ring, and depending on the convergence of the point, the depth of penetration in one single ring can be quite considerable and results in damage to the wearer of the protective garment. The rings are joined together in such protective layers in a manner that the rings are interlaced, that is, they are joined together in a chain-like manner to form a two-dimensional protective layer. One possible solution to this problem would be a sufficiently small size of the rings, but because of the special manufacturing technique the manufacturing costs may rise high and as for the manufacturing technique, it may prove even impossible to provide so closed a structure as is desired. The material of the rings (metal wire) must possess certain thickness to afford sufficient tensile strength to the layer, but on the other hand, forming of rings having sufficiently small diameters from a thick material may be difficult in the manufacturing technique. The ratio inner diameter/material thickness must have a certain minimum value.

The purpose of the invention is to eliminate the above-described drawbacks and to present a protective garment of the kind that prevents efficiently the penetration of sharp pointed objects through the garment, being thus particularly well suitable for persons that may in their duty be exposed to an attack performed with a sharp spike-shaped object, for example for policemen and prison guards. For achieving this purpose the protective garment according to the invention is mainly characterized in that elongate filling elements of limited flexibility are threaded through the rings to prevent the penetration of spike-shaped objects through the rings. One filling element can thus decrease the free area of the surrounding rings as seen in the direction of the impact, and although there remains some free space between an individual ring and the filling element extending therethrough, it is so small that, at the latest, the section widening after the point of the spike-shaped object will become stuck therein. The filling elements have sufficient strength and limited flexibility, which means that they are rigid to such extent that they maintain their positions when the object is penetrating into the ring and do not form a bend next to the object.

Furthermore, the invention has some advantageous embodiments presented in accompanying dependent claims 2 to 10 and in the description hereinbelow. Metal or metal alloy is preferably used as material for the filling elements so that at least the outer layer thereof is of metal, for example twisted metal wire braided on a lighter core consisting of another material.

Figure 2:
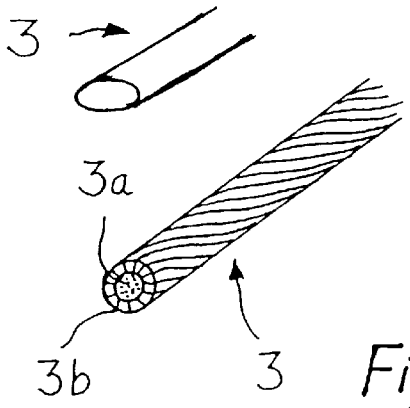
Figure 3:
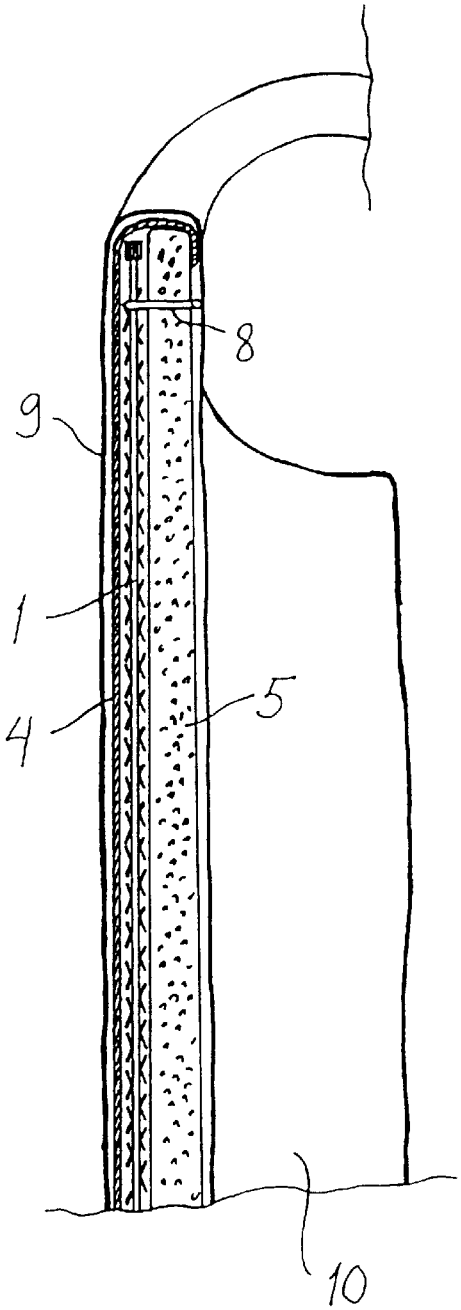

The invention will be described in the following more closely with reference to the appended drawing wherein FIG. 1 shows the construction and attachment of the protective layer of the protective garment according to the invention in front view, FIG. 2 shows the filling elements to be used in the invention in perspective view, and FIG. 3 shows the upper part of the protective garment according to the invention in vertical section.

In FIG. 1 is shown a protective layer 1 against impacts seen in the front, that is, in the direction of impacts. The basic structure of the protective layer consists of rings 2 joined together by interengaging them in chain-like fashion. The rings engage thus each other to form a two-dimensional layer, as seen in the front view. The layer can not unravel, because it is constituted of closed rings connected permanently to each other. The structure of the ring net of this type is well-known previously, and it is formed by end-to-end welding of short lengths of metal wire, such as steel wire to form the rings and to interconnect them. Also the manufacturing method and the devices used therein are previously known.

In the practice the ring net structure extending along a plane is accomplished in such a manner that it has-parallel ring rows 1*a*. In one row the rings are inclined mainly parallelly to each other to a certain acute angle with the main plane, and in the adjacent row the rings are inclined with regard to the main plane of the layer 1 to an angle of approximately the same magnitude but to an opposite direction. Every two adjacent ring rows 1*a* are connected in such a fashion that two successive rings 2 of one row 1*a* are intersected by a common ring 2 of the adjacent row 1*a,* which ring is thus inclined with respect to the main plain of the layer to an acute angle having a magnitude equal to and a direction opposite to the angles of the said two rings. The layer is in this way formed of adjacent rows 1*a,* where the rings 2 of every other row are substantially parallel. The most common material of the rings is steel, but also titanium is possible, provided that it can be welded sufficiently well.

The ring rows 1*a* constitute straight passages in the direction of the main plane of the layer 1. Elongate filling elements 3 are passed through the passages. One filling element 3 extends thus through successive rings 2 of the same row 1*a* so as to fill the free space otherwise present inside the ring. The elements 3 have limited flexibility, bending to such an extent that in the longitudinal direction of the filling elements 3 the layer possesses flexibility required by the use of the garment. In the direction perpendicular to the longitudinal direction of the filling elements the protective layer 1 is more flexible, because the adjacent ring rows 1*a* are able to turn in relation to each other unprevented by the filling elements. Hence, the most advantageous orientation of the filling elements 3 in the garment is vertical, the garment fitting well around a vertical body part such as chest, abdomen and back. The ring rows extending from above downwards are in this case attached at their upper ends to the upper ends of the respective filling elements 3 using a suitable solution, for example as shown in FIG. 1, by means of a lug 6 attached to the upper end of the element 3 and connected to the uppermost ring 2 through a fixing loop 7. In this way the elongate filling elements 3 at the same time keep the layer sufficiently extended in vertical direction and prevent it from slipping down. It will be sufficient to have such attachments only in some elongate filling elements 3 at certain intervals. Correspondingly, the lower ends of the elongate elements can be equipped with similar attachments to prevent the layer 1 from slipping towards the middle in opposite direction, for example in the event that the garment is temporarily positioned upside down during storage.

FIG. 1 further shows how the layer 1 can be attached to backing material for example by means of a yarn 8, which passes at certain intervals along the width through the rings 2 at the upper ends of the ring rows 1*a*. The layer 1 can be attached in the same way along its side edge and lower edge to the backing material to be described hereinbelow.

FIG. 2 shows the structure of the filling element 3 in more detail. The elongate element 3 has sufficient width in the direction of the plane of the layer 1 so as to fill well the inner space of the ring 2. The ratio of this width to the inner diameter of the ring is preferably such that (D-d)/2 is not higher than 3 mm, preferably not higher than 2,5 mm and most preferably not higher than 2 mm, D representing in the equation the ring inner diameter in the width direction of the elongate element 3 and d the width of the elongate element 3. The above limit values are thus the widths of the free spaces remaining on both sides of the element when the element passes approximately through the centers of the rings. As apparent from FIG. 1, these void inner parts of the rings are partly covered also by the material of the rings in the adjacent ring rows.

In order to provide the element 3 with sufficient width and strength without need to make it too heavy, it is most preferably manufactured of a component yarn having a metal outer sheath 3*b* withstanding well impacts, and a core 3*a* of a material lighter than the outer sheath. The core can be for example a yarn manufactured of synthetic polymer fiber, natural fiber, ceramic fiber, or metal fiber lighter than the outer sheath. Metal filaments have been multiplied, doubled, double-doubled or braided around the core to form the outer layer 3*b,* resulting in a metal wire rope which is light enough, but strong and rigid. The metal can consist of for example steel, titanium or aluminium filaments, including alloys and combinations of different filaments.

Further, a metal core and plastic coating can be used in the component yarn, or glass, carbon or metal fiber or some combination thereof as the core yarn and over it a plastic coating made by pultrusion can also be used. Also such combination is possible that the metal core is surrounded by a surface layer of natural fiber.

It is apparent that the filling elements can be entirely of the same fibrous material, and for the sake of rigidity filaments of metal, such as steel, titanium, aluminium or some alloy thereof are most suitable. These filaments have been multiplied, doubled, double-doubled or braided to form a yarn.

In the upper portion of FIG. 2 there is shown a filling element 3 having an advantageous cross-section. The dimension of the cross-section of the filling element in the direction of the plane of the layer 1 is greater than in the direction perpendicular to the plane. An element of this shape, being wide in the direction of the plane fills well the inner parts of the rings, which are oval when seen in the direction of the plane. The "flat" yarn construction of this kind can be manufactured for example by braiding.

Regardless of the structure or shape of the filling elements 3, they should have sufficient stiffness to maintain their position blocking the sharp object to prevent its penetration. It can be supposed that the elastic modulus correlates well with these properties related to stiffness, and filling elements with modulus of elasticity not less than 40 $kN/mm^2$ are recommendable.

FIG. 3 shows one example of the protective garment according to the invention in longitudinal section taken vertically, that is, parallelly to the direction of the filling elements 3. The protective layer 1 is situated within the garment, a layer 4 made of ballistic fabric for protection against bullets being placed on the outer side thereof. A woven fabric is preferably used in this location, because when one hits with a spike-shaped object on the side of this layer 4, fibres become detached from the fabric and as they travel together with the object they fill more the void space between the rings 2 and the element 3 in the protective layer 1. The layer 4 can be made of any known ballistic fiber material having properties that allow it to absorb energy of projectiles, for example aramid fiber, VECTRAN fiber (fully aromatic polyester, HBA-HNA copolymer) or PE-fiber (UHMPE, very large-molecular polyethylene). On the inner side of the protective layer 1, that is, towards the body, there is a relatively thick porous insulation layer 5, which can be for example foamed plastic. The purpose of the layer is to increase the distance of the front surface of the impact-receiving layer 1 from the body and also to increase the comfortability to the wearer. The insulating layer 5 acts also as the backing material, to which the protective layer 1 can be attached in the above-described manner by sewing with the yarn. A protective garment equipped with a ballistic fabric and a layer 1 protecting against impacts operates well as a protective garment against both "fast" impacts (bullets) and "slow" impacts (edged weapons). A ballistic fabric can be placed also on the inner side of the layer 1 to afford even more effective protection against bullets.

In the total thickness of the protective garment the protective layer 1 is located clearly near the outer side and spaced from the middle plane, that is, it is shifted towards the direction where the impacts that it is arranged to stop will come from. The thick insulation layer 5 on the inner side is capable of compressing and it will damp the impact energy. The protective garment is further coated on its outer and inner surface with a suitable surface layer 9 which forms a sort of bag around the protective layer 1 and protects the layers 4, 5 remaining inside against wear.

A garment according to the invention is for example a protective vest 10 which can protect the body in the area of the chest or both the chest and back and which has a construction known as such. It is, however, possible to apply the solution of the invention also to coats and other garments. It is also possible that the protective layer 1 can be located only in one area of the garment, for example to protect the most important body parts.

In one practical realization, the protective layer 1 was manufactured from a metal ring net which consisted of wires having the thickness of ca. 0,8 mm. The wires had been welded end-to-end to form rings having the inner diameter of ca. 5,5 mm. Through ring rows consisting of the rings were threaded straight steel wire ropes of the thickness of ca. 2 mm, the cores of which were cotton yarn. In impact tests made in accordance with European Standard EN 412:1993 (width of the spike 3 mm, weight of the falling body together with the blade 1035 g) it was found that the layer prevented effectively the penetration of sharp spike-shaped objects to such depths where they would present danger to the wearer of the protective garment. When a ballistic fabric made of aramid fiber was used in front of the layer 1, a protection was achieved against nickel jacket bullets shot with a 9 mm handgun at a distance of 4 m.

The invention is not restricted above only to the construction shown in the figures, but it can be modified within the inventional idea presented by the claims. Filling elements 3 can be used also in conjunction with ring nets of another construction to fill vacant spaces inside the rings for serving the purpose of the invention. Moreover, the invention is not restricted only to the above-mentioned manufacturing materials, but materials not mentioned or not yet known which give advantageous protection properties can be used therein.

I claim:

1. An impact-resistant protective garment comprising closed rings joined together to form a layer inside the garment to provide protection against impacts, and elongate filling elements of limited flexibility threaded through the rings to prevent the penetration of spike-shaped objects through the rings.

2. A protective garment according to claim 1, wherein the filling elements are threaded in parallel to each other through parallel ring rows.

3. A protective garment according to claim 2, wherein ring rows are constituted of successive rings whose planes lie parallelly to each other and wherein every two successive rings are joined to each other by means of a ring of an adjacent ring row passing through said two rings, the plane of said ring being at an angle to the planes of said two rings.

4. A protective garment according to claim 1, wherein the filling elements are placed to extend from above downwards in the use position of the garment.

5. A protective garment according to claim 4, wherein the rings are attached to the upper ends of the filling elements to prevent the layer from collapsing.

6. A protective garment according to claim 1 wherein at least the outer layer of the filling elements is of metal or metal alloy.

7. A protective garment according to claim 6, wherein the filling elements comprise a core that is lighter than the outer layer.

8. A protective garment according to claim 1, wherein the cross-section of the filling element has a greater dimension in the direction of the plane of the layer than in the direction perpendicular to the plane.

9. A protective garment according to claim 1, wherein on the outer side of the layer protecting against impacts there is a layer made of ballistic fabric.

10. A protective garment according to claim 1, wherein the garment is a protective vest.

* * * * *